US006983857B2

(12) United States Patent
Miller et al.

(10) Patent No.: US 6,983,857 B2
(45) Date of Patent: Jan. 10, 2006

(54) VENTING LINER

(75) Inventors: Albert R. Miller, Hinsdale, IL (US); David N. Moore, Plainfield, IL (US)

(73) Assignee: Phoenix Closures, Naperville, IL (US)

( * ) Notice: Subject to any disclaimer, the term of this patent is extended or adjusted under 35 U.S.C. 154(b) by 6 days.

(21) Appl. No.: 10/609,293

(22) Filed: Jun. 27, 2003

(65) Prior Publication Data

US 2004/0262253 A1 Dec. 30, 2004

(51) Int. Cl.
*B65D 53/00* (2006.01)
*B32B 3/02* (2006.01)

(52) U.S. Cl. ..... 215/270; 215/347; 215/348; 215/349; 215/307; 428/66.3; 428/66.4; 428/66.6

(58) Field of Classification Search ..... 215/307, 215/310, 270, 271, 902, DIG. 4, 347–349; 220/366.1, 203.17; 428/66.3, 66.4, 66.6, 428/137, 304.4, 319.3, 319.7, 319.9
See application file for complete search history.

(56) References Cited

U.S. PATENT DOCUMENTS 2,162,455 A * 6/1939 Hoge ..... 215/310
2,602,559 A * 7/1952 Dryer ..... 215/260
3,589,545 A 6/1971 Carpenter, Jr.
3,963,845 A 6/1976 Dukess
3,971,489 A 7/1976 Welch et al.
3,976,217 A 8/1976 Dukess
4,121,728 A 10/1978 Tagalakis et al.
4,457,440 A 7/1984 Dukess
4,765,499 A 8/1988 von Reis et al.
5,579,943 A 12/1996 Johnson
5,598,940 A 2/1997 Finkelstein et al.
5,601,200 A 2/1997 Finkelstein et al.
5,615,789 A 4/1997 Finkelstein et al.
5,730,306 A * 3/1998 Costa et al. ..... 215/261
5,927,530 A 7/1999 Moore
5,988,426 A * 11/1999 Stern ..... 220/371
6,202,870 B1 3/2001 Pearce
6,602,309 B2 * 8/2003 Vizulis et al. ..... 55/385.4

* cited by examiner

*Primary Examiner*—Robin A. Hylton
(74) *Attorney, Agent, or Firm*—Welsh & Katz, Ltd.

(57) ABSTRACT

A venting cap liner used in a pressurized container closure arrangement. The cap liner includes a multi-layer sandwich structure having a first layer and a generally flat resilient intermediate layer. The layers include at least one perforation extending through the layers to enable gas flow therethrough. The first layer has a first surface including at least one channel extending from one edge of the first layer to another edge of the first layer. The intermediate layer is responsive to a gas pressure level in the container such that, at a first selected pressure level, the perforation extending through said second layer opens to allow gas to flow through the perforation and at a second selected pressure level, the intermediate layer expands to close the perforation thereby resisting gas flow.

11 Claims, 3 Drawing Sheets

VENTING LINER

BACKGROUND OF THE INVENTION

The present invention relates to a venting liner, and more particularly to a layered venting liner used in an associated container closure assembly for venting pressure from the container at a specified pressure level.

Venting liners used in container closure assemblies are generally known in the art. When a container is packaged with a product that evolves a gas, or placed in a condition in which excessive pressure might arise, the venting liner allows the excessive pressure to vent from the container into the atmosphere, thus precluding breakage of the closure or the container.

Some venting liners have limited performance and are capable of operating properly only under specific conditions. For example, in some cases, if the closure is threaded to the container with excessive torque, a generally excellent hermetic seal between the liner and the container is obtained, however, because such a strong seal is created under excessive internal pressure, venting may be prevented. This may result in the container bursting, or it would be deformed sufficiently to render it commercially unacceptable to the consuming public. On the other hand, if the closing torque applied to the closure is too low, a hermetic seal might not be obtained, and more importantly the pressurized gas might escape to the atmosphere.

Some venting liners that provide for venting from a container do not maintain a continuous seal with the container, enabling repetitive venting. For example, U.S. Pat. No. 4,121,728 to Tagalakis et al, illustrates a container closure assembly including a venting liner. The venting liner has a breakable seal that disengages the lip of the container to allow excess pressure to vent from the container. The disadvantage of such an arrangement is that once the venting liner breaks from the lip of the container, the liner cannot hermetically reseal with the container lip. The inability to maintain a continuous sealed connection with the container lip, after venting, renders the liner and container susceptible to fluid leakage.

To overcome this problem, venting liners with hydrophobic membranes have been utilized and allow the passage of various gasses from decreasing the pressure of the container while perfecting a seal for containing a liquid. For example, the U.S. Pat. No. 3,951,293 to Schulz, discloses a gas permeable liquid closure for containers of liquids or solids which emit or absorb gas. The closure includes a film of tetrafluoroethylene. The film is supported across an opening of the container by a perforated sealing diaphragm, which is disposed on either one or both sides of the film. Problems have arisen with the use of hydrophobic membrane layers in sealing caps, in that the hydrophobic membranes are most often quite fragile and are unable to perfect a seal between a cap and the lip of an opening of a container resulting in a damaged membrane and imperfect hermetic seal.

Other venting liners permit bi-directional venting, which permits the gas to vent from the container as well as enter the container. U.S. Pat. No. 5,730,306 to Costa et al discloses a venting liner used for bi-directional venting. The liner includes a gas permeable layer that allows gas to exit the container at a specified pressure level, as well as enter the container. Bi-directional venting is unsuitable in cases where the container has been packed with a particular gas to protect the product inside of the container and must maintain only that specific gas in the container in order to preserve the product. The present invention overcomes these problems by providing a venting liner able to vent excess pressure from the container while still maintaining a continuous sealed connection between the liner and container. A further advantage of the present invention is a venting liner, according to the invention, capable of repetitively venting excess pressure while simultaneously preventing liquid from escaping the container by utilizing a pressure responsive expandable layer that enables excessive pressure to vent from the associated container.

SUMMARY OF THE INVENTION

In accordance with the present invention, there is provided a multi-layer sandwich structure venting cap liner, having two or more layers either one of which or both may be made of an expandable and resilient foamed intermediate layer. All layers include preferably a plurality of relatively small perforations, which facilitate the release of pressure from the container. When the foam layer is expanded, it forms a seal over the corresponding perforations, preventing excess gas or liquid to enter or exit the container. These perforations extending through the layers to provide controlled gas flow therethrough at a desired or predetermined pressure level. The perforations are preferably in the shape of cylindrical rod-like extrusions and extend completely vertical through all the liner layers forming a straight communication between all the layers, and forming a parallel relationship between the perforations themselves. The first layer has a first surface adjacent to the end panel of the cap and a second surface is adjacent to the intermediate or second layer. In one embodiment of the invention, the first layer has at least one grooved channel extending from one edge of the first layer to another edge of the first layer extending horizontally across the first layer.

The intermediate or second layer is positioned between the first layer and the third layer. The intermediate layer is preferably constructed from a foam-like material. This intermediate layer is responsive to the pressure in the container such that in a pressurized state, the perforation extending through the second layer open to allow gas to flow through and, in an ambient state the second layer expands to close the perforation, in turn resulting in a layer being impervious to the outside pressures, moisture and contamination while simultaneously containing the contents of the closure.

The optional third layer has a first surface adjacent to the intermediate or second layer and a second surface adjacent to the mouth of said container. The cap liner controls the pressure level in the container. When the pressure inside of the container is at a selected pressure level, the venting liner allows gas to flow through the perforation, and when the pressure inside of the container is at a second selected pressure level, the venting liner seals the container, resisting gas flow from the container.

BRIEF DESCRIPTION OF THE DRAWINGS

The objects and advantages of the present invention will become apparent to those of ordinary skill in the art after reviewing the following detailed description and accompanying drawings, wherein.

DETAILED DESCRIPTION OF THE INVENTION

Figure 1:
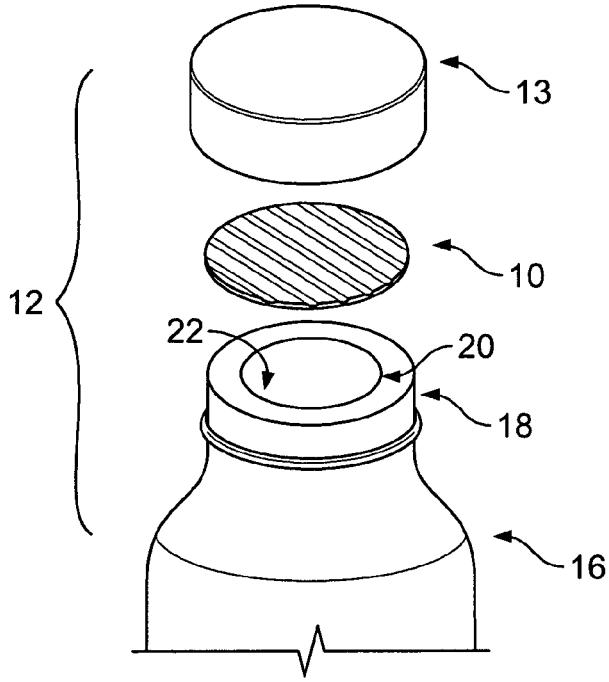
FIG. 1 is an exploded view of a container closure assembly including the venting liner.

While the present invention is susceptible of embodiment in various forms, there is shown in the drawings an embodiment of the present invention that is discussed in greater detail hereafter. It should be understood that the present disclosure is to be considered as an exemplification of the present invention, and is not intended to limit the invention to the specific embodiment illustrated. It should be further understood that the title of this section of this application, namely "Detailed Description of the Invention" relates to a requirement of the United States Patent and Trademark Office, and should not be found to be limiting to the subject matter disclosed herein.

In the present disclosure, the words "a" or "an" are to be taken to include both the singular and the plural. Conversely, any reference to plural items shall, where appropriate, include the singular.

Referring now to the drawings, and more particularly to FIG. 1, there a venting liner 10 and associated container closure assembly 12 is shown. The container closure assembly 12 includes a cap 13, and a container 16. The container 16 extends upward forming a neck 18 and a lip 20, which defines an opening 22. The opening 22 enables communication with the inside of the container 16. The venting liner 10 is generally disk-shaped to be fitted on the surface or opening 22 of the container 16. It is contemplated that the venting liner 10 can have virtually any desired shape without departing from the scope of the present invention, so long as it encompasses and secures the container opening 22.

Figure 2:
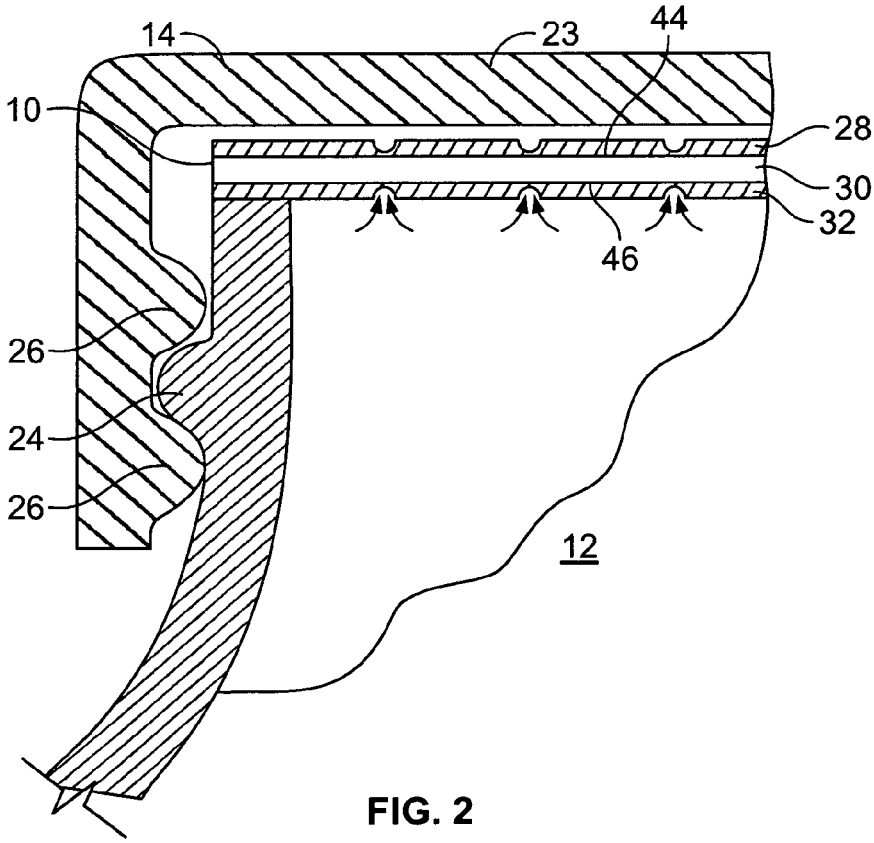
FIG. 2 is an enlarged fragmentary sectional view of the venting liner and associated container closure in a closed ambient state.

Referring now to FIG. 2, there is shown a cross-sectional view of a venting liner and an associated container closure assembly 12, in accordance with the present invention. The cap 14 is secured to the container 16 for providing closure to the container opening 22. In the preferred embodiment, the cap 14 includes an end panel 23 and lugs 26. The lugs 26 extend outward towards the container 16 to provide a threaded connection with the threads 24 of the container. It is contemplated that the cap 14 can be secured to the container 16 using other mechanisms or devices generally known to those skilled in the art, without departing from the scope of the present invention.

The venting liner 10 is intermediately disposed between the end panel 23 of the cap 14 and the sealing lip 20 of the container. In this arrangement, the engaging surface of the venting liner 10 is hermetically sealed to the container lip 20.

Figure 3:
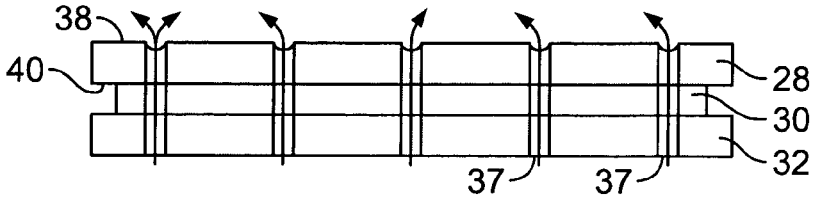
FIG. 3 is a sectional view of the venting liner illustrating the pressure responsive core in a closed ambient state.

The venting liner 10 can be a multi-layered structure, having two or more layers either of which may be made of the resilient foam material. As illustrated in FIGS. 2 and 3 the multi-layer venting liner preferably include a top or first layer 28, an intermediate or second layer 30, and an optimal bottom or third layer 32. In the preferred embodiment, the liner 10 has a thickness ranging between 0.016" and 0.056", however it is contemplated that the liner 10 can have any thickness without departing from the novel scope of the present invention. In the preferred embodiment, the liner 10 has a density ranging between 4.0 and 40.0 lbs/ft$^3$, however it is to be noted that the liner can have any density without departing from the novel scope of the present invention.

The venting liner 10 includes one or more perforations 37, extending through the layers for enabling pressure inside of the container 16 to vent into the atmosphere. Preferably, the perforations 37 are in the shape of cylindrical rod-like extrusions and extend completely vertical through all the liner layers, forming a parallel relationship between the perforations, which preferably have a width ranging between 0.001" and 0.035" in diameter. The perforations 37 are formed in the liner 10 in a desired pattern. To insure that the perforations 37 vent at the desired levels, the frequency of the perforation pattern and number of perforations can be determined by the size of the cap 13 and liner 10 and specified application. The perforations 37 can be made using a punch, laser or other suitable means generally known to those skilled in the in the art.

The top layer 28 includes an upper surface 38 and a lower surface 40. The upper surface 38 of the top layer 28 is placed in adjacent contact with the end panel 23 of the container cap 13, and the lower surface 40 of the top layer 28 is adjacent to the second layer 30. Preferably, the lower surface 40 is connected to the second layer 30. Preferably, the top layer 28 is comprised of a plastic material such as, polyvinylchloride (PVC), polypropylene (PP), low density polyethylene (LDPE), high density polyethylene (HDPE), ethylvinylacetate (EVA) or the like. However, pulp may also be used.

As illustrated in FIGS. 2 and 3, the second or intermediate layer 30 is connected to the first layer 28 and positioned between the first layer 28 and the container 16. In the preferred embodiment, the second layer 30 is positioned between the first layer 28 and the third layer 32.

The second or intermediate layer 30 has a generally flat first surface 44 and a generally flat second surface 46. The first surface 44 is connected to the lower surface 40 of the first layer 28 and the second surface is positioned adjacent to the third layer 32. The second layer 30 is constructed from a pressure responsive, expandable material such as foam, thermoplastic rubber (TPR), polyvinylchloride (PVC), polypropylene (PP), low density polyethylene (LDPE), high density polyethylene (HDPE) or ethylvinylacetate (EVA) or the like. In the preferred embodiment, the second layer 30 is comprised of an expandable fluid impermeable, gas impermeable or impenetrable material. Preferably, the second layer has a thickness between 0.010" and 0.050".

In accordance with the first layer 28, the second layer 30 includes one or more openings or perforations 37 extending therethrough. Preferably, the perforations 37 are in alignment and/or communication with the perforations 37 of the first layer 28, as well as any additional layers, if provided.

The optional bottom or third layer 32 includes an upper surface 54 and a lower surface 52. The lower surface 52 is placed in adjacent contact with the container lip 20 and the upper surface 54 is connected to the lower surface 48 of the second layer 30. The bottom layer 32 is formed from a polymeric material such as thermoplastic rubber (TPR), polyvinylchloride (PVC), polypropylene (PP), low density polyethylene (LDPE), high density polyethylene (HDPE) or ethylvinylacetate (EVA) or the like.

Notably, while the above-described embodiment discloses three layers, those skilled in the art recognize that the venting liner 10 can include any number of layers (less or more) without departing from the novel scope of the present invention.

Figure 4:
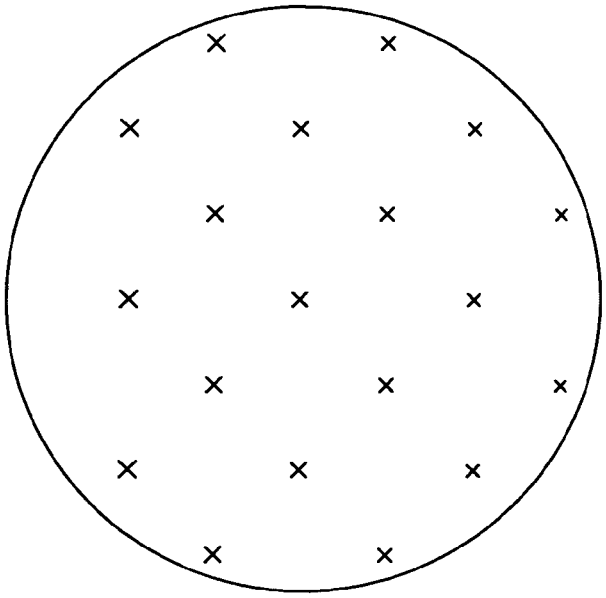
FIG. 4 is a top view of a venting liner is with the pressure responsive core layer in a closed ambient state.

The venting liner 10 enables pressure to vent from the associated container 16 at a selected pressure level. In this manner, the second layer 30 is responsive to internal pressure in the container 16 and atmosphere. When the second layer 30 is penetrated or in an ambient or non-pressurized state, the liner 10 maintains a secure hermetic seal with the container 16. As illustrated in FIGS. 2 and 4, the expandable layer 30 is in an expanded position, closing perforations 37 and preventing gas flow therethrough.

Figure 7:
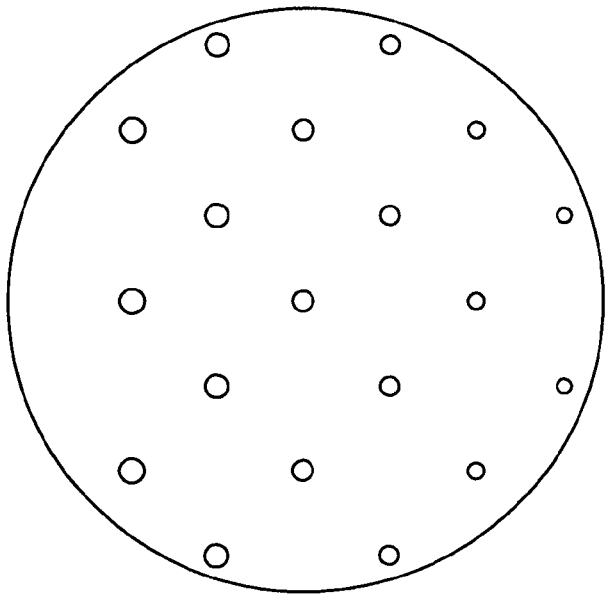
FIG. 7 is a top view of the venting liner illustrating the pressure responsive layer in an open pressurized state.

When gas pressure evolves in the container, building up to a pressurized state at a selected pressure level range, the pressure responsive second layer 30 contracts and the perforations 37 extending through the second layer 30. The perforations 37 open slightly in response to changes in pressure on either the inside of our outside of the container 14, allowing gas to flow through the perforation 37. As illustrated in FIGS. 7–8, when the perforations 37 in the pressure responsive layer 30 open slightly, gas exits the containers through the perforation 37 into the atmosphere.

Figure 5:
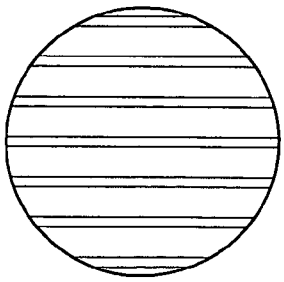
FIG. 5 is a top view of venting liner illustrating the grooved channels in accordance with one embodiment of the present invention.
Figure 6:
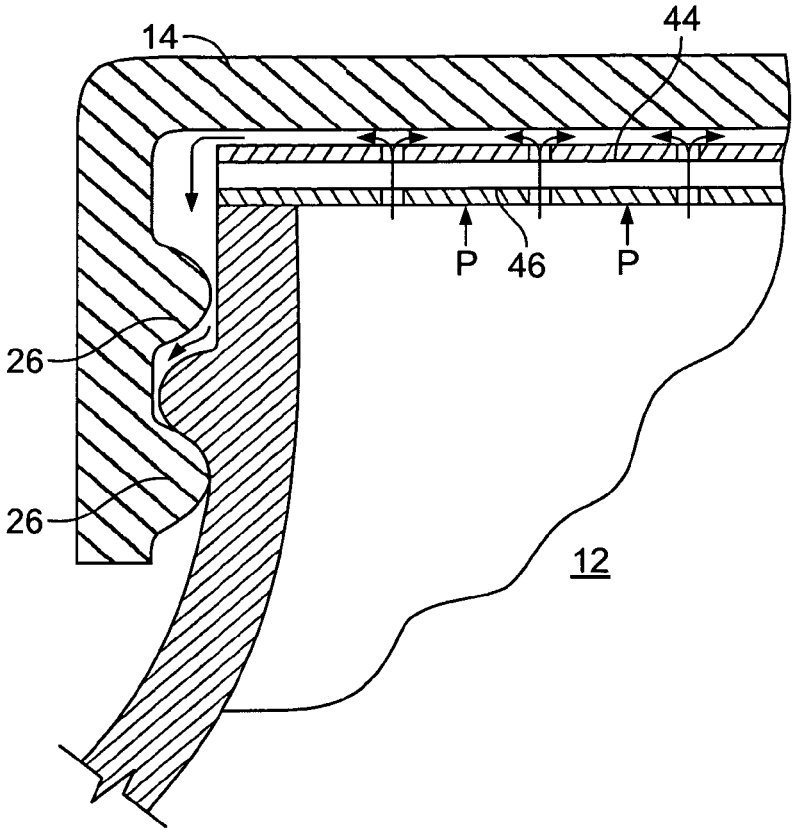
FIG. 6 is an enlarged fragmentary sectional view of the venting liner and associated container illustrating the pressure responsive layer in an open pressurized state.

Optionally, the venting liner 10, includes, preferably in the top layer 28, a plurality of grooved channels 42. The channels 42, as illustrated in FIGS. 3, 6 and a top view in FIG. 5, are in a parallel relationship to each other and extend the entirety of the layer, from one edge of the liner 10 to another edge. In the preferred embodiment, the channels 42 are preferably V-shaped and extend about the diameter of the liner 10 in a spaced apart formation, as illustrated in FIG. 5, however, it is to be noted that the channels 42 can extend about the structure in any manner. Moreover, the channels 42 preferably have a range between 0.003" to 0.020" in depth. However, it is to be noted that the channels 42 can have any depth without departing form the scope of the present invention.

These channels 42, can further facilitate venting of the liner when there is excessive pressure within the container 16 which needs to be vented to atmosphere. Generally, one or more perforations or apertures 37 extend through the first layer 28. In the preferred embodiment, one or more of the perforations 37 are in intersecting communication with one or more channels 42, enabling pressure flow to the outer edges of the liner 10.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims when the claims are properly interpreted.

What is claimed is:

1. A venting liner for a cap and container assembly comprising:

a liner impermeable to a liquid and selectively permeable to a gas, in a form adapted to be positioned over a container opening, being defined by at least three layers, a first layer, an intermediate layer and a third layer, said layers including at least one perforation extending vertically through said first, intermediate and third layers to provide controlled, unimpeded gas flow through said liner at a desired pressure level;

said first layer having an outer surface facing away from said container opening and an inner surface facing toward the container opening, with the at least one perforation being open to ambient conditions outside the outer surface, said intermediate layer consisting of a resilient foam material positioned between said first layer and said third layer and responsive to a pressure in said container such that, in a pressurized state, said intermediate layer is adapted to expand and compress facilitating the passage or prevention of gas flow through the at least one perforations depending on said pressure conditions;

said third layer having a first surface adjacent to said intermediate layer and a second surface adjacent to the container opening, with the at least one perforation being open to ambient conditions inside of the second surface;

wherein said liner controls the pressure level in said container such that when the pressure inside of said container is at a selected pressure level, said venting liner allows gas flow through the perforation, thereby releasing gas flow from said container, and when the pressure inside of said container is at a desired level, said venting liner seals the container, thereby resisting gas flow from said container.

2. The venting cap liner in accordance with claim 1 wherein the liner has a thickness between 0.016" and 0.056".

3. The venting cap liner in accordance with claim 1 wherein the liner has a density between 4.0 and 40.0 lbs/ft$^3$.

4. The venting cap liner in accordance with claim 1 wherein the perforation has a diameter between 0.001" and 0.035".

5. The venting cap liner in accordance with claim 1 wherein the intermediate layer has a thickness between 0.0 10" and 0.050".

6. The venting cap liner in accordance with claim 1 wherein the intermediate layer is formed from an impermeable material.

7. The venting cap liner in accordance with claim 1, wherein said outer surface having at least one channel extending from one edge of the first layer to another edge of the first layer.

8. The venting cap liner in accordance with claim 7 wherein the channel has a depth of between 0.003" and 0.020".

9. The venting cap liner in accordance with claim 7 wherein at least one channel intersects a perforation.

10. The venting cap liner in accordance with claim 7, wherein said first layer further includes a plurality of channels extending across the outer surface from one edge to another.

11. A venting cap liner for use in a pressurized cap and container arrangement, said cap liner comprising:

a multi-layer sandwich structure impermeable to a liquid and selectively permeable to a gas including a first layer, a generally flat resilient intermediate layer, and a third layer, said layers including at least one perforation extending through said first, second and third layers, wherein the at least one perforation being open to ambient conditions inside and outside of the liner to enable gas flow therethrough, said first layer having a first surface opposite a second surface, wherein said first surface is adjacent to said cap and said second surface is adjacent to said intermediate layer, said first surface having at least one channel extending from one edge of the first layer to another edge of the first layer, said intermediate resilient layer being positioned between said first layer and said third layer, said intermediate resilient layer having a generally flat first surface adjacent to the first layer and a generally flat second surface adjacent to the third layer, wherein said intermediate layer is responsive to a gas pressure level in said container such that, at a first selected pressure level, said perforation extending through said intermediate layer opens to allow gas to flow through said perforation and, at a second selected pressure level, said intermediate layer expands to close said at least one perforation thereby resisting gas flow therethrough, said third layer having a first surface adjacent to said intermediate layer and a second surface adjacent to the mouth of said container.

* * * * *